US010304601B2

(12) United States Patent
Tanada

(10) Patent No.: US 10,304,601 B2
(45) Date of Patent: May 28, 2019

(54) MAGNETIC BODY AND COIL COMPONENT USING THE SAME

(71) Applicant: TAIYO YUDEN CO., LTD., Taito-ku, Tokyo (JP)

(72) Inventor: Atsushi Tanada, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 241 days.

(21) Appl. No.: 15/465,472

(22) Filed: Mar. 21, 2017

(65) Prior Publication Data

US 2017/0287605 A1 Oct. 5, 2017

(30) Foreign Application Priority Data

Mar. 31, 2016 (JP) ..... 2016-071953

(51) Int. Cl.

| | |
|---|---|
| ***H01F 27/24*** | (2006.01) |
| ***H01F 1/147*** | (2006.01) |
| ***H01F 27/255*** | (2006.01) |
| ***H01F 1/28*** | (2006.01) |

(52) U.S. Cl.

CPC ..... *H01F 1/14766* (2013.01); *H01F 1/28* (2013.01); *H01F 27/24* (2013.01); *H01F 27/255* (2013.01)

(58) Field of Classification Search

CPC ..... H01F 5/00; H01F 27/00–27/36
USPC ..... 336/65, 83, 90, 200, 232–234
See application file for complete search history.

(56) References Cited

U.S. PATENT DOCUMENTS

| | | | | |
|---|---|---|---|---|
| 9,892,834 | B2 * | 2/2018 | Ogawa | B22F 1/02 |
| 2012/0188049 | A1 * | 7/2012 | Matsuura | B22F 1/02 336/212 |
| 2012/0274437 | A1 * | 11/2012 | Matsuura | H01F 1/14783 336/221 |
| 2013/0015939 | A1 | 1/2013 | Inagaki et al. | |

(Continued)

FOREIGN PATENT DOCUMENTS

| | | | |
|---|---|---|---|
| CN | 102822913 | A | 12/2012 |
| CN | 103650074 | A | 3/2014 |

(Continued)

OTHER PUBLICATIONS

A First Office Action issued by the State Intellectual Property Office of China dated Aug. 2, 2018 for Chinese counterpart application No. 201710208134.6.

*Primary Examiner* — Tuyen T Nguyen
(74) *Attorney, Agent, or Firm* — Law Office of Katsuhiro Arai

(57) ABSTRACT

In an embodiment, a magnetic body includes: multiple soft magnetic alloy grains 11, 12 each containing Fe, element L (where element L is Si, Zr or Ti), and element M (where Element M is an element other than Si, Zr, and Ti, and which oxidizes more easily than Fe); oxide films 21, 22 covering the soft magnetic alloy grains, respectively; a bonding material 30 constituted by an oxide that exists separately from the oxide films 21 (21A, 21B), 22 (22A, 22B); first bonds where adjacent soft magnetic alloy grains 11, 12 are bonded together via the oxide films 21, 22; and second bonds where adjacent soft magnetic alloy grains 11, 12 are bonded together via the bonding material 30, without the oxide films 21, 22 that respectively cover these grains making direct contact with each other.

20 Claims, 4 Drawing Sheets

(56) References Cited

U.S. PATENT DOCUMENTS

| | | | | |
|---|---|---|---|---|
| 2014/0104031 | A1 | 4/2014 | Ogawa et al. | |
| 2016/0293308 | A1* | 10/2016 | Ryu | C22C 38/34 |

FOREIGN PATENT DOCUMENTS

| | | | |
|---|---|---|---|
| JP | 2013026356 | A | 2/2013 |
| JP | 2015144238 | A | 8/2015 |

* cited by examiner

MAGNETIC BODY AND COIL COMPONENT USING THE SAME

BACKGROUND

Field of the Invention

The present invention relates to a magnetic body that can be used primarily as a magnetic core for coils, inductors, and other electronic components, as well as a coil component using such magnetic body.

Description of the Related Art

Electronic components such as inductors, choke coils, transformers, etc. (so-called coil components and inductance components) have a magnetic body as their magnetic core, and a coil formed inside or on the surface of the magnetic core. For the material of magnetic body, Ni—Cu—Zn ferrite and other types of ferrite are generally used.

There has been a demand for electronic components of this type to accommodate greater current (have higher current ratings) in recent years, and to meet this demand, switching the material of magnetic bodies from the traditional ferrite materials to metal materials is being studied. Metal materials include Fe—Cr—Si alloy and Fe—Al—Si alloy, and, for example, Patent Literature 1 discloses a soft magnetic compacted powder magnetic core containing soft magnetic metal grains whose primary component is Fe, where an oxide part is present at the entire space between adjacent soft magnetic metal grains.

Background Art Literatures

[Patent Literature 1] Japanese Patent Laid-open No. 2015-144238

SUMMARY

In response to the recent demand for electronic components of smaller size and higher performance, it is desired that magnetic bodies offering both high strength and high resistance without necessitating a marked drop in magnetic permeability are provided. One object of the present invention is to provide one such magnetic body. Additionally, another object of the present invention is to provide an electronic component containing such magnetic body.

Any discussion of problems and solutions involved in the related art has been included in this disclosure solely for the purposes of providing a context for the present invention, and should not be taken as an admission that any or all of the discussion were known at the time the invention was made.

The magnetic body proposed by the present invention has multiple soft magnetic alloy grains, oxide films, bonding material, as well as first and second bonds. The soft magnetic alloy grain contains Fe, element L, and element M. Element L is Si, Zr, or Ti. Element M is an element other than Si, Zr, and Ti, and which oxidizes more easily than Fe. The oxide films cover individual soft magnetic alloy grains, respectively. The bonding material is constituted by an oxide that exists separately from the oxide films. At the first bonds, adjacent soft magnetic alloy grains are bonded together via the oxide films that respectively cover these soft magnetic alloy grains. At the second bonds, adjacent soft magnetic alloy grains are bonded together via the aforementioned bonding material, without the oxide films that respectively cover these grains making direct contact with each other.

According to the present invention, a magnetic body offering both high strength and high resistance without necessitating a marked drop in magnetic permeability is provided.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

DETAILED DESCRIPTION OF EMBODIMENTS

Figure 1:
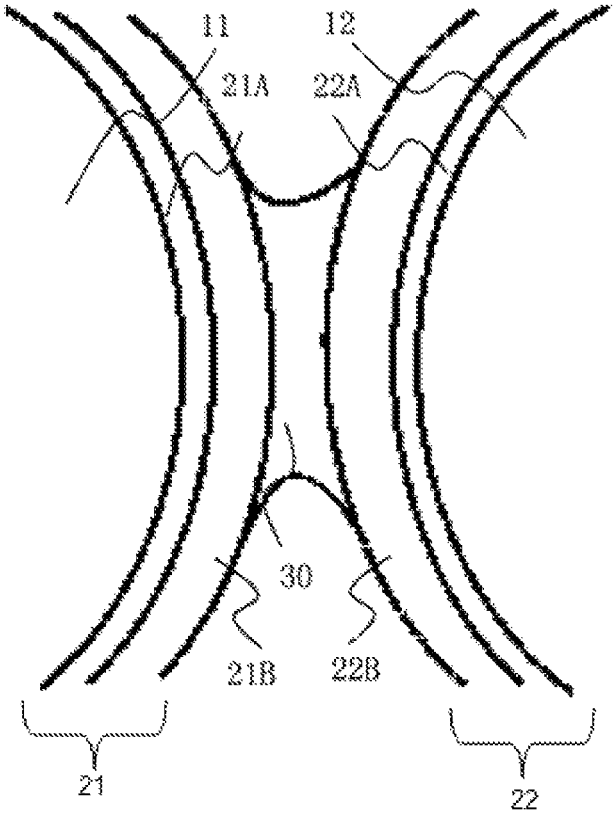
FIG. 1 is a schematic section view showing a detailed structure in the vicinity of the second bond in the magnetic body proposed by the present invention.

The present invention is described in detail by referring to the drawings as deemed appropriate. It should be noted, however, that the present invention is not limited to the illustrated mode in any way, and that, because the characteristic parts of the invention may be emphasized in the drawings, accuracy of scale is not necessarily assured in each part of the drawings.

Figure 2:
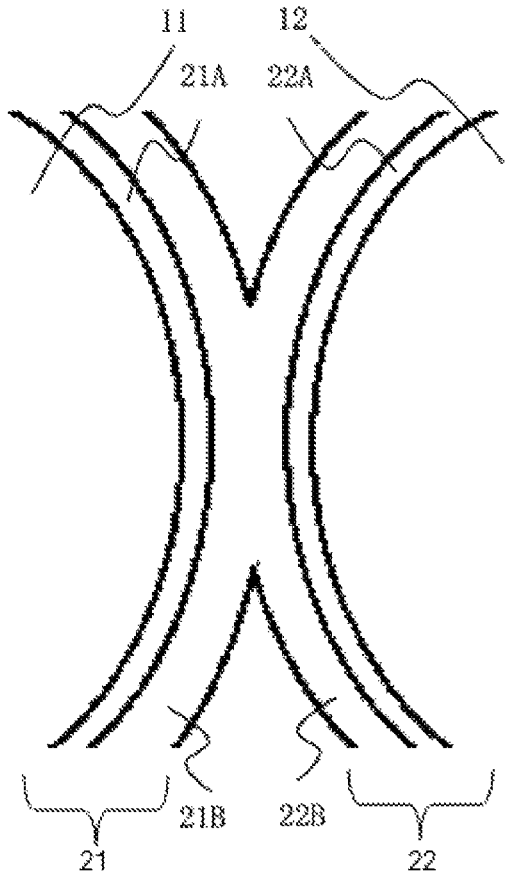
FIG. 2 is a schematic section view showing a detailed structure in the vicinity of the first bond in the magnetic body proposed by the present invention.

FIGS. 1 and 2 are each a schematic section view showing a detailed structure of the magnetic body proposed by the present invention. FIG. 1 provides a schematic representation of the vicinity of the second bond signifying a particularly characteristic bond under the present invention, while FIG. 2 provides a schematic representation of the vicinity of the first bond embodying a bonding mode different from the second bond. These two bonds are described later.

Under the present invention, the magnetic body is understood as an assembly of many soft magnetic alloy grains that were originally independent but are now bonded together. The magnetic body can also be characterized as a compacted powder constituted by many soft magnetic alloy grains. Referring to FIG. 1, oxide films 21, 22 are formed on at least some soft magnetic alloy grains 11, 12 in a manner covering at least some parts, or preferably almost all, of their circumference, and these oxide films 21, 22 ensure the insulation property of the magnetic body.

With the magnetic body proposed by the present invention, at least two types of bonding modes are available between adjacent soft magnetic alloy grains. These are called the first bond and the second bond.

FIG. 2 shows the vicinity of the first bond. At the first bond shown in FIG. 2, the adjacent soft magnetic alloy grains 11, 12 are bonded together via the oxide films 21, 22 present around the respective soft magnetic alloy grains 11, 12 (first oxide-to-oxide bonding). "Bonded together via oxide films" means that the oxide films around the two soft magnetic alloy grains 11, 12 are shared at least in some parts.

FIG. 1 shows the vicinity of the second bond. At the second bond shown in FIG. 1, the oxide films 21, 22 do not make direct contact with each other, which means that this bonding mode (second oxide-to-oxide bonding) is completely different from that of the first bond. The oxide films 21, 22 are formed separately and independently around the adjacent soft magnetic alloy grains 11, 12, respectively. At the second bond, a bonding material denoted by symbol 30 exists separately from the oxide films 21, 22. The bonding material 30 connects the oxide films 21, 22 as if to bridge them.

Presence of the first and second bonds mentioned above can be visually recognized on a SEM-observed image enlarged to approx. 20000 times, for example. Presence of first and second bonds improves the mechanical strength and insulation property. Preferably adjacent soft magnetic alloy grains are bonded together via first or second bonds over the entire magnetic body; however, the mechanical strength and insulation property will improve sufficiently so long as both first and second bonds are present, no matter how small their numbers may be, and this mode is also considered an embodiment of the present invention. Additionally, in some parts, soft magnetic alloy grains can be bonded (or fused) together directly (metal-to-metal bonding), not via oxide films. Furthermore, a mode where adjacent soft magnetic alloy grains are simply in physical contact with or in close vicinity of each other without any bonding, e.g., without first or second bonds between them or without areas where soft magnetic alloy grains are bonded together directly, can be present partially.

According to the present invention, the soft magnetic alloy grains contain at least iron (Fe) and two elements other than Fe. Of the two elements, one is Si, Zr, or Ti, and is called element L. The other of the two elements is an element other than Si, Zr, and Ti, and which oxidizes more easily than Fe, and is called element M.

Preferably element L is Si. Preferably element L accounts for 3 to 6 percent by weight of the magnetic body.

Element M may be, for example, Cr (chromium), Al (aluminum), or the like. Preferably element M accounts for 3 to 6 percent by weight of the magnetic body.

The soft magnetic alloy grain can contain additional elements besides Fe, element L, and element M, where such elements may be, for example, S (sulfur), P (phosphorus), C (carbon), or the like.

The overall composition of the magnetic body can be measured by energy dispersive X-ray spectroscopy (EDS) according to the ZAF method.

At least some individual soft magnetic alloy grains have an oxide film formed at least in some parts around them. Oxide film can be formed in the material grain stage before the magnetic body is formed, or alternatively oxide film can be generated in the magnetic body forming stage by keeping it non-existent or allowing it to be present in very limited quantity in the material grain stage. Preferably such oxide film is constituted by an oxide of the soft magnetic alloy grain itself. Oxide film can be obtained by partially oxidizing the surface of soft magnetic alloy grains by heat treatment before the magnetic body is formed, followed by further oxidization of the surface of soft magnetic alloy grains when forming the magnetic body. Presence of oxide film can be recognized as a contrast (brightness) difference on an observed image taken by a scanning electron microscope (SEM) and enlarged to approx. 20000 times. Presence of oxide film assures the insulation property of the magnetic body as a whole.

Preferably the part of oxide film contacting the soft magnetic alloy grains (L-rich oxide films 21A, 22A) contains element L. The method for measuring the chemical composition of oxide film is described below. First, the magnetic body is fractured or otherwise its section is exposed. Next, the section is smoothed by ion milling, etc., and its image is taken with a scanning electron microscope (SEM), after which the image is analyzed by energy dispersive X-ray spectroscopy (EDS) according to the ZAF method. Oxide film can be recognized by conducting a linear analysis of the soft magnetic alloy grain from its surface in an outward direction using STEM (scanning transmission electron microscope)-EDS to measure the composition of the respective parts of the oxide film.

Through such measurement, first of all an interface of grain surface and oxide film can be confirmed from an increase in oxygen from the soft magnetic alloy grain in an outward direction. Next, in the aforementioned oxide film, presence of element L is confirmed on the outer side of where the oxide film contacts the grain surface. The presence of oxygen indicates that this is an oxide film of element L. This oxide film of element L represents a range where element L is contained by 50 percent or more relative to the total of element L and the components other than element L, except for oxygen. Furthermore, presence of element M is confirmed on the outer side of parts contacting the oxide film of element L. This oxide film of element M (M-rich oxide films 21B, 22B) represents a range where element M is contained by 50 percent or more relative to the total of element M and the components other than element M, except for oxygen.

Also, as shown in FIG. 2, the first bond is formed by the aforementioned oxide film. The first bond is formed by the oxide films present on the surfaces of the respective soft magnetic alloy grains. Furthermore, at this first bond, the oxide films of element M are bonded together (i.e., the M-rich oxide films 21B, 22B are mutually bonded together). This bond of oxide films of element M provides mechanical strength to the magnetic body. Also, at the first bond, bond of oxide films of element L is non-existent (i.e., the L-rich oxide films 21A, 22A are not mutually bonded together). As a result, present at the first bond between the grains are the oxide film of element L (the L-rich oxide film 21A, 22A) on each of two adjacent grains, the oxide film of element M (the M-rich oxide film 21B) on one of the two grains, and the oxide film of element M (the M-rich oxide film 22B) on the other grain. The presence of the two oxide films of element L (i.e., the two L-rich oxide films 21A, 22A) at the first bond achieves high insulation between these grains.

Also, as shown in FIG. 1, the bonding material 30 is present in the magnetic body proposed by the present invention, separately from the oxide films 21, 22. The bonding material is an oxide. The bonding material is "present separately" from the oxide films, because it is understood as a morphology different from that of the oxide films 21, 22 formed around the soft magnetic alloy grains 11, 12, having a different crystalline morphology (the crystal phases of the two are different, such as one is crystalline material and the other is non-crystalline material), chemical composition, etc. This can be understood by SEM or TEM or the aforementioned measurement of chemical composition.

The bonding material 30 is an oxide. The composition of the oxide constituting the bonding material is not limited in any way, and the oxide may be an element other than element L in the alloy grain; however, preferably the oxide contains element L. Presence of such oxide containing element L achieves high resistance and high strength of the magnetic body, and also increases its withstand voltage. Particularly when element L is Si, the withstand voltage increases further. When the oxide film on the grain surface is thin, very small defects are likely to form in the oxide film; because the bonding material 30 is present, however, these defects are filled and even eliminated, particularly from the oxide film around the second bond. As a result, desired magnetic permeability is maintained because the oxide film is thin, but at the same time the withstand voltage can be increased due to the presence of the bonding material. As for the presence of the bonding material, presence of element L is confirmed on the outer side of parts contacting the oxide film of element M. The presence of oxygen indicates that this is an oxide film of element L. This bonding material is achieved when element L is contained by 50 percent or more relative to the total content of element L and the components other than element L, except for oxygen. In other words, the second bond is where bonding occurs via an oxide film of element L. At this second bond, too, the two adjacent grains have the oxide film of element L (the L-rich oxide film 21A) on one grain, the oxide film of element M (the M-rich oxide film 21B) on one grain, the bonding material (the L-rich oxide material 30), the oxide film of element M (the M-rich oxide film 22B) on the other grain, and the oxide film of element L (the L-rich oxide film 22A) on the other grain, between them. The presence of the two oxide films of element L, and the bonding material, achieves higher insulation between these grains. The second bond may bond the M-rich oxide films 21B and 22B without any intervening layer. In some embodiments, the L-rich oxide film 21A, 22A may not exist (although element L may be present on the surface of grains, it does not form a continuous film covering the grains). Further, Fe-rich oxide film (not shown in FIGS. 1 to 3) (wherein Fe is contained by 50 percent or more relative to the total content of Fe and the components other than Fe, except for oxygen) is typically formed outside the M-rich oxide film 21B, 22B, although the Fe-rich oxide film does not significantly contribute to bonding of grains (the Fe-rich oxide film is typically not involved in the first, second, and third bonds).

Figure 3:
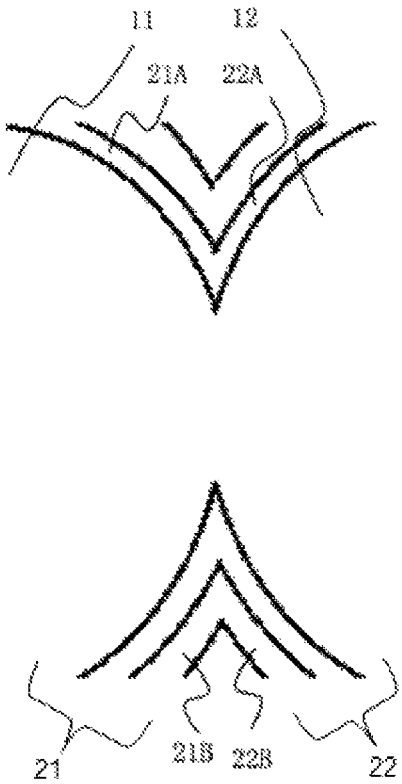
FIG. 3 is a schematic section view showing a detailed structure in the vicinity of the third bond in the magnetic body proposed by the present invention.

Furthermore, as shown in FIG. 3, the soft magnetic alloy grains can be bonded together directly, other than at the first and second bonds. Crystal continuously covers the metal parts of the grains, where there is no oxide. This is clear from the continuous alignment of crystal over these parts. For example, this can be determined from the parallel orientations of crystal shown on an image of a sample prepared in the same manner as for the evaluation of oxide film, taken with a scanning transmission electron microscope (STEM) and observed at magnifications of approx. 100000 times. High magnetic permeability can be achieved by this bond of metal parts of grains.

Under the present invention, the abundance ratios of the first, second and third bonds as mentioned above can be adjusted in the order of the first bonds, second bonds and third bonds, from the highest to the lowest, to achieve higher insulation, strength and withstand voltage characteristics. In this disclosure, "bonding" (or "bond") means joining or adhering, more than contacting, to the extent that after formation of the bonds, adjacent grains can be securely attached to each other independently of any other elements, e.g., without any other binder material or any other intervening layer and without any other force or pressure, regardless of whether such other elements are present or absent. In embodiments, the sintered magnetic body can sustain its shape by the first, second, and third bonds without other bonds although such other bonds may partly exist (e.g., bonds between L-rich oxide films) and although voids described below may be filled with a filling material.

Figure 4:
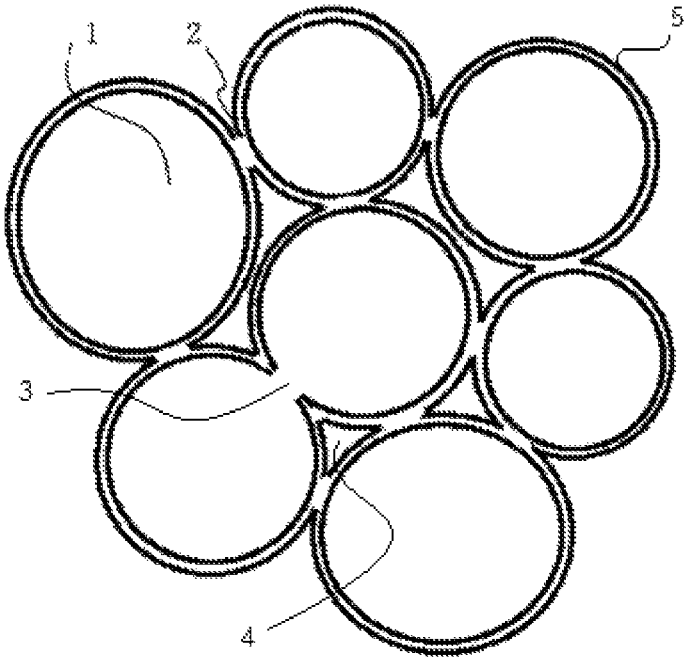
FIG. 4 is a schematic section view showing multiple magnetic alloy grains in the magnetic body proposed by the present invention.

The magnetic body proposed by the present invention can have voids in some parts, where preferably the porosity is 1 to 2 percent. The porosity is specified in HS-R1634. Modest voids as described above stabilize the oxide films and achieve mechanical strength and magnetic permeability at high levels. In this condition, voids are present around the second bonds. If there is no void, whatever is present to fill the voids prevents the fill ratio of magnetic grains from being raised and also makes it difficult to supply oxygen into the magnetic body from the outside the magnetic body, and consequently oxide film will not be formed sufficiently in some parts and, as a result, the magnetic permeability will drop and so will the insulation property and strength. In other words, the aforementioned porosity due to voids, or specifically open pores, allows for stable formation of oxide film while ensuring a desired fill ratio. FIG. 4 is a schematic partial view illustrating how magnetic grains are bonded to each other in a magnetic body according to an embodiment, wherein soft magnetic alloy grains 1 are covered with oxide film 5, and adjacent grains 1 are bonded to each other via bonding parts 2 (oxide-to-oxide bonding) or direct bonding 3 without any intervening parts, and voids 4 (typically continuous) are present between oxide-covered grains. In an embodiment, each bonding part 2 consists of the first bond (M-rich oxide film bonding) or the second bond (L-rich oxide material bonding), and direct bonding 3 consists of the third bond (metal-to-metal bonding). In an embodiment, the oxide film 5 is constituted by an L-rich oxide film (21A, 22A), an M-rich oxide film (21B, 22B), and a Fe-rich oxide film (not shown in FIGS. 1-3).

The composition of the soft magnetic alloy grain used as the material is reflected in the composition of the magnetic body finally obtained. Accordingly, a desired composition can be selected for the material grain as deemed appropriate according to the composition of the magnetic body finally obtained, and a preferable range for this composition is the same as the preferable range for the composition of the magnetic body as mentioned above.

The sizes of individual material grains are virtually the same as the sizes of the grains constituting the magnetic body finally obtained. Preferably the size of the material grain is 2 to 30 μm based on average grain size d50 when the magnetic permeability and intragranular eddy current loss are considered. The d50 of the material grain can be measured using a laser diffraction/scattering measurement apparatus.

Preferably the material magnetic grains are manufactured according to the atomization method. Under the atomization method, primary materials Fe, Cr, and Si, as well as additive material S, are melted in a high-frequency melting furnace, followed by atomization, to obtain magnetic grains.

Next, the magnetic grains thus obtained are pre-treated on their surfaces with what will become the bonding material. The pre-treatment involves coating the surfaces of the magnetic grains by depositing fine grains of element L which is Si, Ti, or Zr. The material used here is prepared as a colloidal solution, for example. The fine grains of element L have an average grain size of 1 to 20 nm, are added by 20 to 30 percent by weight, and dispersed using water or toluene as the medium. The methods to coat the grains include soaking them in the colloidal solution, and spraying the colloidal solution onto the grains, among others. For example, the soaking method can be used when forming a thin, uniform coat on the surfaces of magnetic grains, or the spray method can be used when forming a non-uniform coat. Particularly when a non-uniform film is formed, any drop in fill ratio due to the presence of the film can be suppressed. This spray method allows for formation of a non-uniform film without causing extreme aggregation of magnetic grains, so long as a specific solution droplet size and drying of dispersion medium are set.

Following this pre-treatment, the coating material exists between the grains and the grains aggregate together via the coating material. Preferably in this aggregated state, the grains have the coating material present between them, but not deposited on any other part. In other words, ideally there is no excess coating material and drop in fill ratio can be suppressed in the aforementioned aggregated state. This pre-treatment provides what will become the bonding material after the heat treatment described later. By using this method, a magnetic body can be created without letting its fill ratio drop (no substantial reduction of fill ratio).

The method to obtain a compact from the aforementioned pre-treated material grains is not specifically limited in any way, and any known means for manufacturing a grain compact can be adopted as deemed appropriate. The following explains a typical manufacturing method whereby the material grains are compacted under non-heating conditions and then given heat treatment. It should be noted, however, that the present invention is not limited to this manufacturing method.

When the material grains are compacted under non-heating conditions, preferably organic resin is added as a binder. For the organic resin, preferably organic resin constituted by acrylic resin, butyral resin, vinyl resin, etc., whose thermal decomposition temperature is 500° C. or less is used so that not much binder will remain after the heat treatment. Any known lubricant may be added when compacting. The lubricant may be organic salts, etc., where specific examples include zinc stearate and calcium stearate. The amount of lubricant is preferably 0 to 1.5 parts by weight relative to 100 parts by weight of material grains. The amount of lubricant being zero means that no lubricant is used. Any binder and/or lubricant are/is added to the material grains and the mixture is agitated and then compacted to a desired shape. When compacting, 1 to 30 t/cm$^2$ of pressure is applied, for example.

A favorable mode of heat treatment is explained.

Preferably the heat treatment is performed in an oxidizing ambience. To be more specific, the oxygen concentration during heating is preferably 1% or more, as this makes it easier for first bond via the oxide film and second bond via the bonding material to generate. No specific upper limit of oxygen concentration is set, but one example is the oxygen concentration in air (approx. 21%) in consideration of the manufacturing cost, etc. Preferably the heating temperature is 600 to 800° C. from the viewpoint of oxidizing the surface layers of the soft magnetic alloy grains themselves to produce oxide films and thereby facilitate the formation of first bonds, and also from the viewpoint of producing the bonding material to facilitate the formation of second bonds. Also, from the viewpoint of facilitating the formation of first and second bonds, preferably the heating time is 3.5 to 6 hours. By adjusting the heating time within the aforementioned range, oxide films can be formed sufficiently inside the magnetic body, allowing for formation of oxide films containing element L (L-rich oxide films), and oxide films containing element M (M-rich oxide films) on the outer side thereof. Also, the longer the heating time or higher the heating temperature, the higher the abundance ratio of element M (e.g., Cr) becomes in the oxide films formed. In other words, an oxide film of high abundance ratio of element L (L-rich oxide film) is present on the surface of the magnetic grain, an oxide film of high abundance ratio of element M (M-rich oxide film) is present on the outer side of the L-rich oxide film, and furthermore an oxide film of high abundance ratio of element L (L-rich oxide material, e.g., Si-rich oxide material) originating in the bonding material from the pre-treatment is present on the outer side of the M-rich oxide film and constitutes the second bond. It should be noted that the oxide film of element L (L-rich oxide film) is formed thinner than the oxide film of element M (M-rich oxide film), and that the first bond is a part of the oxide film of element M. These oxide films respectively contribute to the magnetic permeability and insulation property, and strength.

Figure 5:
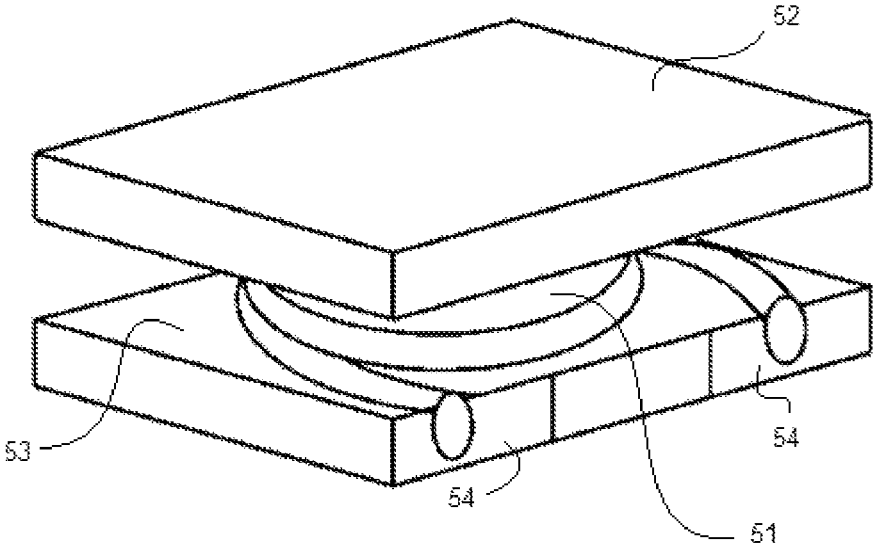
FIG. 5 is a schematic perspective view of an example of coil component using the magnetic body proposed by the present invention.

The magnetic body thus obtained can be used as a magnetic core for various electronic components. For example, an insulator-coated conductive wire can be wound around the magnetic body proposed by the present invention to form a coil. Or, green sheets containing the aforementioned magnetic grains can be formed according to a known method and specified patterns formed on them by printing or otherwise applying a conductor paste, after which the printed green sheets can be stacked and pressurized and the formed sheets heat-treated under the aforementioned conditions to obtain an electronic component (inductor) constituted by the magnetic body proposed by the present invention and a coil formed therein. Besides the above, the magnetic body proposed by the present invention can be used as a magnetic core by forming a coil inside or on the surface of it, to obtain various electronic components. Various mounting types of electronic components such as those of surface mounted type and of through hole mounted type are supported, and for the means for obtaining an electronic component from the magnetic body, the one described in "Examples" below may be referenced or any known manufacturing method used in the field of electronic components may be adopted as deemed appropriate. FIG. 5 is a schematic view of a coil component according to an embodiment, wherein any of the magnetic body disclosed herein is used as a pillar around which an insulator-coated conductive wire is wound, constituting a coil 51 (an upper flange 52 and a lower flange 53 are integrally attached to the respective ends of the pillar), and the lower flange 53 is provided with two terminals 54 to which the respective ends of the wire are connected.

EXAMPLES

The present invention is explained below in greater detail using examples. It should be noted, however, that the present invention is not limited in any way to the embodiments described in these examples.

(Material Grains)

Alloy powders with a composition of Fe—Cr—Si, Fe—Zr—Cr, or Fe—Si—Al were used for the material grains. The compositions of alloy powders were measured by energy dispersive X-ray spectroscopy (EDS) according to the ZAF method. The chemical compositions of alloys are shown below.

Comparative Example 1 Si (3 wt %), Cr (6 wt %), Fe (remainder)

Comparative Example 2 Si (3 wt %), Cr (6 wt %), Fe (remainder)

Comparative Example 3 Si (3 wt %), Cr (6 wt %), Fe (remainder)

Comparative Example 4 Si (3 wt %), Cr (6 wt %), Fe (remainder)

Example 1 Si (3 wt %), Cr (6 wt %), Fe (remainder)

Example 2 Si (6 wt %), Cr (1.5 wt %), Fe (remainder)

Example 3 Si (6 wt %), Cr (1.5 wt %), Fe (remainder)

Example 4 Si (6 wt %), Cr (1.5 wt %), Fe (remainder)

Example 5 Si (6 wt %), Cr (1.5 wt %), Fe (remainder)

Example 6 Si (6 wt %), Cr (1.5 wt %), Fe (remainder)

Example 7 Si (6 wt %), Cr (1.5 wt %), Fe (remainder)

Example 8 Si (6 wt %), Cr (1.5 wt %), Fe (remainder)

Example 9 Si (6 wt %), Al (1.5 wt %), Fe (remainder)

Example 10 Si (8 wt %), Cr (1.5 wt %), Fe (remainder)

Example 11 Si (8 wt %), Cr (1 wt %), Fe (remainder)

(Spraying onto Grains)

The respective surfaces of the aforementioned alloy powders used were coated. Material constituted by fine grains of element L being Si, Zr, or Ti, and toluene as the medium were used. The fine grain materials all had an average grain size of 5 nm, and were provided as liquid colloidal solutions with an additive quantity of 25 percent by weight. The coating method is as follows: while agitating the colloidal solution of alloy powder, droplets of the solution were sprayed with a nozzle in such a way that they became smaller than the average grain size of the alloy powder, with the solution dried simultaneously with the spraying or after the spraying, and this spraying and drying were repeated. Coating by this method allows a formed product to be obtained that suffers less drop in fill ratio as a result of forming. Also, because the coating material contains fine grains of element L, the fine grains of element L are sintered simultaneously as the formation of oxide film during heat treatment, or after the formation of oxide film, to allow for formation of bonding material.

Comparative Example 1 Not sprayed.

Comparative Example 2 Not sprayed.

Comparative Example 3 Not sprayed.

Comparative Example 4 Not sprayed.

Example 1 Si coating material, 20 minutes

Example 2 Si coating material, 20 minutes

Example 3 Si coating material, 30 minutes

Example 4 Si coating material, 40 minutes

Example 5 Si coating material, 60 minutes

Example 6 Si coating material, 40 minutes

Example 7 Zr coating material, 30 minutes

Example 8 Zr coating material, 30 minutes

Example 9 Si coating material, 30 minutes

Example 10 Si coating material, 30 minutes

Example 11 Si coating material, 30 minutes (Manufacture of Magnetic Body)

100 parts by weight of the alloy powder that has been coated as above as necessary, were mixed under agitation with 1.5 parts by weight of a PVA binder of 300° C. in thermal decomposition temperature, and the mixture was formed into grains. Thereafter, the grains were pressed under the forming pressure (unit: ton/cm$^2$) below into the shape for each of the evaluations described later, and after the binder was removed therefrom, the formed product obtained was heated at 650° C. in an oxidizing ambience of 21 percent in oxygen concentration, for a holding time of one hour in the case of each Comparative Example, and four hours in the case of each Example. This heat treatment yielded each magnetic body. A magnetic body with voids can be obtained through the aforementioned process consisting of coating, forming, and sintering.

Comparative Example 1 3.7

Comparative Example 2 4.3

Comparative Example 3 5.0

Comparative Example 4 6.0

Example 1 6.0

Example 2 10

Example 3 10

Example 4 12

Example 5 14

Example 6 14

Example 7 12

Example 8 12

Example 9 12

Example 10 14

Example 11 14

(SEM Observation)

On SEM-observed images enlarged to 20000 times, the magnetic bodies obtained in all Examples and Comparative Examples had almost all of their individual alloy grains covered with an oxide film, where adjacent alloy grains were observed to be bonded together via their respective oxide films. Furthermore, in all Examples (not Comparative Examples), adjacent alloy grains were observed to be bonded together not via oxide films, but bonded together via layers of metal grain, oxide film, oxide grains (bonding material), oxide film, and metal grain arranged in this order, in some parts, where each oxide grain different from the oxide films was sandwiched in between. The oxide grains were constituted by a Si oxide in the case of Examples 1 to 6, 9, 10, and 11, and a Zr oxide in the case of Examples 7 and 8. Such bond where a granular oxide (oxide grain) different from the oxide films was sandwiched in between, was not observed in Comparative Examples.

(Composition of Oxide Film)

The compositions of oxide films were examined using TEM-observed images enlarged to 20000 times.

In Comparative Examples 1 to 4 and Example 1, a Cr oxide film was formed on parts contacting the alloy grain, and a Fe oxide film was formed on the outer side of the Cr oxide film. Presence of Si oxide on the inner side of the Cr oxide film was confirmed, but a continuous presence of Si which would constitute an oxide film was not confirmed, and presence of Si was discontinuous. Continuous presence over at least one-third of the observed, polished surface of the magnetic grain is enough to justify the characterization of "continuous." This continuous presence can be confirmed by continuation of pixels on an element map image taken at the aforementioned magnifications.

In Examples 2 to 7 and 9 to 11, a Si oxide film was formed on parts contacting the alloy grain, and a Cr or Al oxide film was formed on the outer side of the Si oxide film, and furthermore a Fe oxide film was formed on the outer side of the Cr/Al oxide film.

In Example 8, a Zr oxide was formed on parts contacting the alloy grain, and a Cr oxide film was formed on the outer side of the Zr oxide film, and furthermore a Fe oxide film formed on the outer side of the Cr oxide film.

In addition, in cases where oxide film was continuously present as described above, greater insulation could be achieved. Here, when the grains are assumed to have the same size and these grains are combined in such a way that a triple point is formed, the grains should contact with one another at an angle of 120° at this point. In fact, the angle of 120° corresponds to a range of one-third the grain surface. This means that, if the aforementioned continuous Si oxide film is present over this one-third range or more, the probability of a Si oxide film being present between the grains increases. That is to say, achievement of greater insulation is possible if, in the aforementioned observation, there is a continuous Si oxide film over a range of one-third or more of the grain surface.

(Porosity)

Porosities of the obtained magnetic bodies were measured according to JIS-R1634. The measured results are shown below.

Comparative Example 1 3.1%
Comparative Example 2 2.5%
Comparative Example 3 2.3%
Comparative Example 4 2.2%
Example 1 2.3%
Example 2 2.0%
Example 3 1.8%
Example 4 1.0%
Example 5 0.8%
Example 6 0.7%
Example 7 2.0%
Example 8 2.0%
Example 9 2.0%
Example 10 1.9%
Example 11 1.9%

(Permeability)

A toroidal magnetic body of 14 mm in outer diameter, 8 mm in inner diameter and 3 mm in thickness was manufactured for measuring magnetic permeability μ. A 0.3-mm diameter coil constituted by urethane-coated copper wire was wound around this magnetic body by 20 turns, to obtain a measuring sample. The magnetic permeability of the magnetic body was measured at a measuring frequency of 100 kHz using an L chrome meter (4285A manufactured by Agilent Technologies).

(Mechanical Strength)

Mechanical strength was measured according to JIS-R1601. To be specific, a magnetic body having the shape of a plate of 50 mm in length, 4 mm in width, and 3 mm in thickness, was manufactured as a measurement sample, and this sample was used to measure three-point bending fracture stress. In the "Measured Results" section below, the measured results of "Strength" are shown in the unit of $kgf/cm^2$.

(Electrical Resistance)

Volume resistivity was measured according to JIS-K6911. To be specific, a magnetic body having the shape of a disk of 9.5 mm in outer diameter and 4.2 to 4.5 mm in thickness, was manufactured as a measurement sample. When the aforementioned heat treatment was given, an Au film was formed by sputtering on both of the bottom surfaces (entire bottom surfaces) of the disk. Voltage of 25 V (60 V/cm) was applied to both sides of the Au film. The resulting resistance value was used to calculate the volume resistivity. In the "Measured Results" section below, the measured results of "Resistance" are shown in the unit of Ω·cm.

(Withstand Voltage)

A disk-shaped magnetic body of 9.5 mm in outer diameter and 4.2 to 4.5 mm in thickness was manufactured as a measuring sample, for measuring withstand voltage. When the aforementioned heat treatment was applied, Au film was formed by sputtering on both of the end surfaces (entire upper and lower surfaces) of the disk. Voltage was applied to both sides of the Au film to perform I-V measurement. The applied voltage was gradually raised and when the current density reached 0.01 $A/cm^2$, the voltage applied then was considered the breakdown voltage. The sample was ranked 1 if the breakdown voltage was less than 250 V, 2 if the breakdown voltage was 250 V or more but less than 500 V, or 3 if the breakdown voltage was 500 V or more.

(Measured Results)

Measured results of each of the aforementioned physical properties are shown below.

| | Magnetic permeability | Strength | Resistance | Withstand voltage |
|---|---|---|---|---|
| Comparative Example 1 | 32 | 5 | $10^7$ | 1 |
| Comparative Example 2 | 40 | 7 | $10^6$ | 1 |
| Comparative Example 3 | 46 | 8 | $10^5$ | 1 |
| Comparative Example 4 | 50 | 9 | $10^3$ | 1 |
| Example 1 | 50 | 11 | $10^4$ | 1 |
| Example 2 | 50 | 12 | $10^4$ | 2 |
| Example 3 | 49 | 14 | $10^5$ | 3 |
| Example 4 | 48 | 17 | $10^6$ | 3 |
| Example 5 | 41 | 11 | $10^7$ | 3 |
| Example 6 | 52 | 18 | $10^4$ | 2 |
| Example 7 | 49 | 14 | $10^5$ | 2 |
| Example 8 | 49 | 14 | $10^5$ | 2 |
| Example 9 | 49 | 14 | $10^6$ | 3 |
| Example 10 | 49 | 15 | $10^5$ | 3 |
| Example 11 | 49 | 15 | $10^3$ | 1 |

In all Examples, both high strength and high resistance were achieved without necessitating a marked drop in magnetic permeability. In Examples 2 to 7 and 9 where a Si oxide was formed on parts contacting the alloy grain, the withstand voltage also improved. Similarly, in Example 8 where a Zn oxide was formed on parts contacting the alloy grain, the withstand voltage also improved. Also, comparison of Examples 3 against Examples 7 and 8, all of which presented the same magnetic permeability, finds that the withstand voltage is higher in Example 3, which suggests that Si oxide is more effective than Zr oxide. On the other hand, while the resistance and withstand voltage are both high in Example 10, the resistance and withstand voltage are both lower in Example 11. These results indicate that it is better to have Cr by 1.5 percent by weight or more, and more element L than element M.

In the present disclosure where conditions and/or structures are not specified, a skilled artisan in the art can readily provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

The present application claims priority to Japanese Patent Application No. 2016-071953, filed Mar. 31, 2016, the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

I claim:

1. A magnetic body, comprising:

multiple soft magnetic alloy grains each containing Fe, element L (where element L is Si, Zr or Ti), and element M (where Element M is an element other than Si, Zr, and Ti, and which oxidizes more easily than Fe);

oxide films covering the soft magnetic alloy grains, respectively;

a bonding material constituted by an oxide that exists separately and discretely from the oxide films;

first bonds where adjacent soft magnetic alloy grains are bonded together by film-to-film bonding of the oxide films that respectively cover the soft magnetic alloy grains; and second bonds where adjacent soft magnetic alloy grains covered with oxide films are bonded together via the bonding material without the first bonds where the oxide films that respectively cover these grains do not make direct contact with each other, said magnetic body being sintered.

2. A magnetic body according to claim 1, wherein the oxide films contain element L where they contact surfaces of the soft magnetic alloy grains.

3. A magnetic body according to claim 1, wherein element L is Si.

4. A magnetic body according to claim 2, wherein element L is Si.

5. A magnetic body according to claim 1, wherein a porosity of the magnetic body is 1 to 2 percent.

6. A magnetic body according to claim 2, wherein a porosity of the magnetic body is 1 to 2 percent.

7. A magnetic body according to claim 3, wherein a porosity of the magnetic body is 1 to 2 percent.

8. A magnetic body according to claim 4, wherein a porosity of the magnetic body is 1 to 2 percent.

9. A coil component comprising a magnetic body and a coil, wherein the magnetic body is that according to claim 1.

10. A coil component comprising a magnetic body and a coil, wherein the magnetic body is that according to claim 2.

11. A coil component comprising a magnetic body and a coil, wherein the magnetic body is that according to claim 3.

12. A coil component comprising a magnetic body and a coil, wherein the magnetic body is that according to claim 4.

13. A coil component comprising a magnetic body and a coil, wherein the magnetic body is that according to claim 5.

14. A coil component comprising a magnetic body and a coil, wherein the magnetic body is that according to claim 6.

15. A coil component comprising a magnetic body and a coil, wherein the magnetic body is that according to claim 7.

16. A coil component comprising a magnetic body and a coil, wherein the magnetic body is that according to claim 8.

17. A magnetic body according to claim 1, wherein each oxide film is constituted by an L-rich oxide film and an M-rich oxide film, wherein the first bonds are formed by the M-rich oxide films.

18. A magnetic body according to claim 17, wherein the bonding material is constituted by an L-rich oxide material.

19. A magnetic body according to claim 1, further comprising third bonds where adjacent soft magnetic alloy grains are bonded directly together by metal-to-metal bonding.

20. A magnetic body according to claim 19, wherein adjacent soft magnetic alloy grains are bonded solely by the first and second bonds or the first, second, and third bonds, wherein the magnetic body is substantially free of other binding material.

* * * * *